United States Patent [19]

Featherman

[11] Patent Number: 4,467,729

[45] Date of Patent: Aug. 28, 1984

[54] WIDE SPAN SHELVING

[75] Inventor: Daniel J. Featherman, Philadelphia, Pa.

[73] Assignees: Franklyn Featherman; Bernard Featherman, both of Philadelphia, Pa.

[21] Appl. No.: 350,234

[22] Filed: Feb. 19, 1982

[51] Int. Cl.[3] ..... A47F 5/10

[52] U.S. Cl. ..... 108/107; 211/191; 248/243

[58] Field of Search ..... 108/107, 111, 114; 211/191, 192, 193

[56] References Cited

U.S. PATENT DOCUMENTS

| | | | |
|---|---|---|---|
| 3,510,010 | 5/1970 | Gasner | 211/192 X |
| 4,064,996 | 12/1977 | Shillum | 108/107 |
| 4,067,445 | 1/1978 | Derclaye | 211/191 |
| 4,197,952 | 4/1980 | De Fouw et al. | 211/191 |
| 4,287,994 | 9/1981 | Klein | 211/191 |

FOREIGN PATENT DOCUMENTS

| | | | |
|---|---|---|---|
| 479278 | 11/1969 | Switzerland | 211/191 |

*Primary Examiner*—William E. Lyddane
*Assistant Examiner*—Peter A. Aschenbrenner
*Attorney, Agent, or Firm*—Frank P. Cyr

[57] ABSTRACT

A shelved storage rack has end frames including end posts and cross-beams therebetween. The beams each comprise a vertical panel having a reverse bend therefrom which results in an outwardly extending horizontal flange adapted to support a deckplate; the vertical panel being longitudinally extended at each end with regard to the flange; and a removable planar connector plate fastened along the longitudinal face of each panel extension. First and second tab means extending from the plate in the beam in a longitudinal direction and overlying, in operative association with, a face of the post. The first tab means terminating in inwardly directed hook means which secure on aperture defining structure in said post face.

4 Claims, 10 Drawing Figures

WIDE SPAN SHELVING

BACKGROUND OF THE INVENTION

Industrial steel storage shelving is normally produced in two basic types. One, a flat panel shelf that is usually hand loaded and another type being a heavy duty rack that is machine loaded by fork trucks or the like. Recently, a different type shelving has appeared and is presently in use and known as a wide span shelving which is used primarily to support thereon articles of relatively light weight.

With the above in mind, it is one object of the invention to provide a wide span shelving which can be mass produced by use of conventional equipment with a minimum of labor costs.

Another object of the invention is to construct a wide span type shelving which may be either factory assembled and shipped to the user thereof in erected condition or the same may be shipped in knockdown condition for assembly at site of use of the shelving.

Another object of the invention is to provide a wide span type shelving with a minimum of cross bracing so as to economize on the material employed in the construction of the wide span type shelving.

Another object of the invention is to employ a beam section for the shelving which is provided at the opposite ends thereof with a clip formation which will engage with upright members which will retain the shelving in proper upright position and which will eliminate the employment of some of the cross bracing usually found in shelving to thereby stabilize the shelving arrangement.

These and other objects and advantages of the invention will become apparent upon reading the following description in conjunction with the accompanying drawings.

DESCRIPTION OF THE PREFERRED EMBODIMENTS

Figure 1:
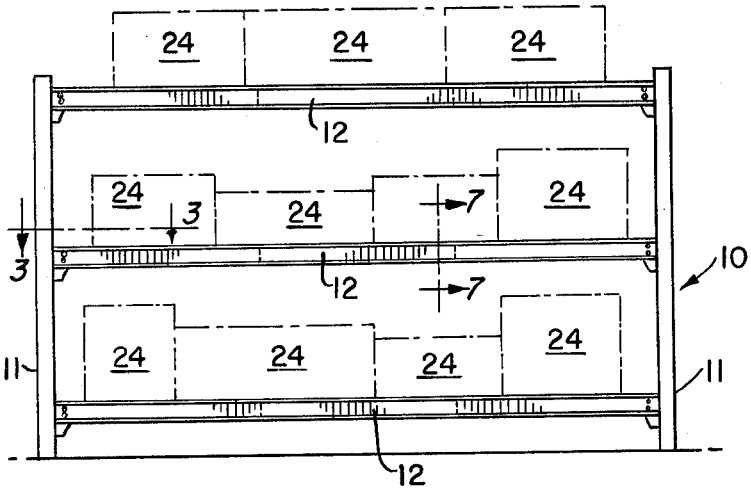
FIG. 1 is a front elevation of the shelving of the present invention showing in dotted lines cartons which have been placed on the shelving.
Figure 2:
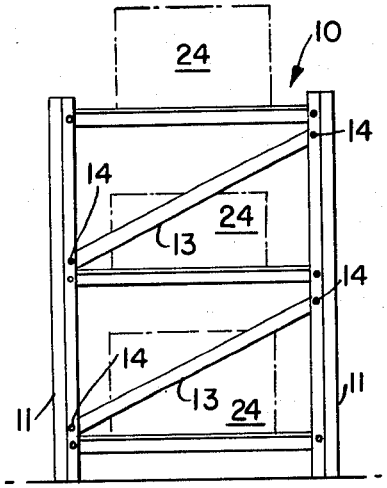
FIG. 2 is a side elevation of the shelving shown in FIG. 1.
Figure 3:
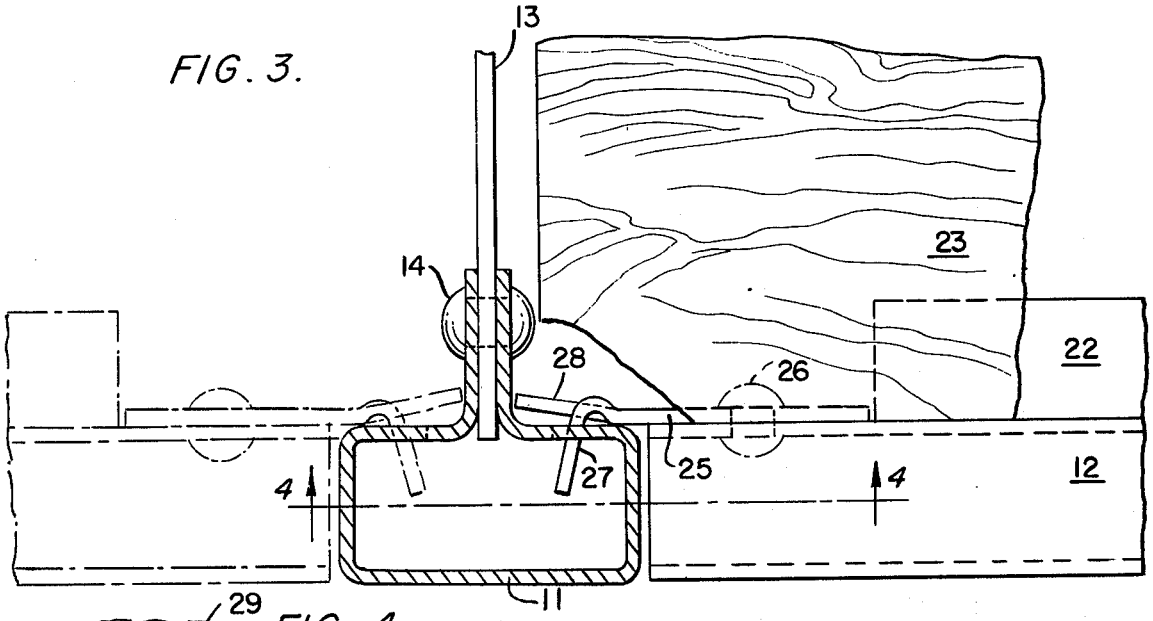
FIG. 3 is a section taken on lines 3—3 of FIG. 1, looking in the direction of the arrows.

Referring now to the drawings wherein like reference numerals are employed to designate like parts throughout the several views, 10 designates in general, the shelving arrangement of the present invention. The shelving comprises a plurality of end frames 11 in the nature of T-shaped vertical posts and horizontally extending cross-beams 12. The end frames 11 comprise a generally rectangular framework with the end frame members 11 secured to one another as by means of diagonal braces 13 which are secured as by rivets 14 or otherwise to the generally T-shaped upright members which form the end frames for the shelving arrangement. As best seen in FIG. 3 of the drawings, the T-shaped upright members receive therein the diagonal brace bar 13 which is secured thereto as aforesaid by the rivets or bolts 14.

Figure 4:
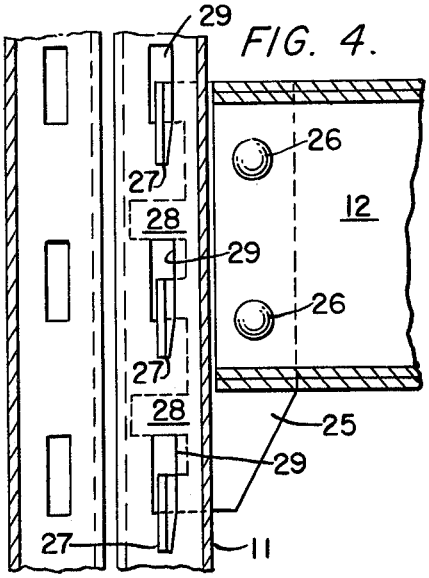
FIG. 4 is a section taken on lines 4—4 of FIG. 3, looking in the direction of the arrows.

Shown in FIGS. 3 and 4 of the drawings, is an installation whereby a vertically extending T-shaped end frame member may be employed for mounting a plurality of side-by-side shelving units. However, since the components of the invention are alike, the description will describe with particularity only one shelf component and the manner of securing the same to the vertical support.

Mounted on the said T-shaped upright member 11 are a plurality of beams 12 and the same are mounted on said T-shaped end frames 11 in a manner to be described more fully hereinafter. Beams 12 are made from sheet metal or if desired, the same may be made from plastic material. The beams can be constructed by a suitable roll forming machine of known construction or by any other known forming machine. However, prior to the roll forming operation, cut-outs 15, 16 are formed in the blank 17 which is to form the beams and openings 18 are also formed in the blank as more clearly shown in FIGS. 9 and 10 of the drawings. It will be appreciated that like cut-outs and openings will be provided at the opposite end of the blank 17 so that when the blank is severed on the line 19, there will be presented a pair of blanks from which a beam 12 is to be constructed and which will be provided with identical end sections. In the formation of the beam whether by roll forming or by other suitable means, both the upper and lower portions of the blank are reversely bent such as shown at 20, 21 of FIG. 7 of the drawings. However, in order to form a lip 22 at the upper portion of the beam, a further bend is imparted to the blank material to form the lip 22 shown in FIG. 7 of the drawings which is adapted to support a deck 23 constructed of plywood, plastic or any other suitable material on which is placed the article 24 to be supported on the shelving arrangement.

Figure 5:
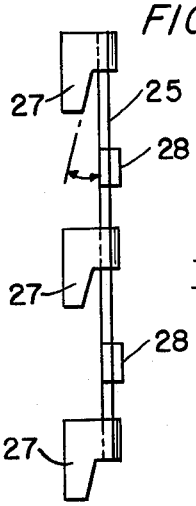
FIG. 5 is an end view of a beam end clip employed in erecting the shelving.
Figure 6:
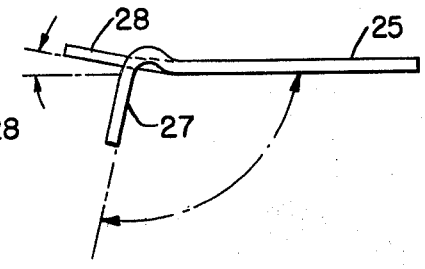
FIG. 6 is a top plan view of the beam end clip shown in FIG. 5 of the drawings.

Mounted on each end of the support beams 12 is a connector clip 25 formed of any suitable material and the clip, which is in the nature of a platelike element, is secured to the beam 12 by means of rivets or bolts 26 which extend through the openings 18 formed in the ends of the support beam 12. As best seen in FIGS. 5 and 6 of the drawings, the clip 25 is provided with a plurality of wedge-shaped hooks 27 and a plurality of projections 28 and as shown in FIG. 6 of the drawings. The projection 28 is bent approximately 5° away from the plane of the clip and the wedge-shaped hooks 27 are bent approximately 100° away from the plane of the clip but in the opposite direction for a purpose to be described more fully hereinafter.

Figure 7:
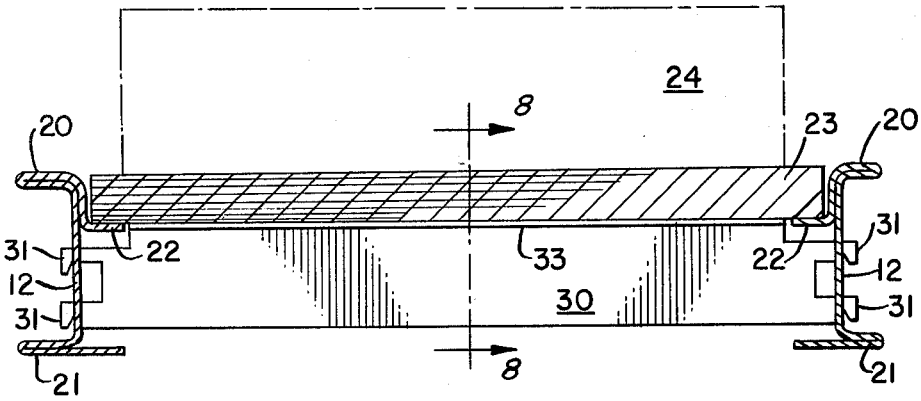
FIG. 7 is a section taken on lines 7—7 of FIG. 1, looking in the direction of the arrows.
Figure 8:
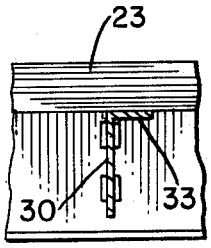
FIG. 8 is a view taken on lines 8—8 of FIG. 7, looking in the direction of the arrows.
Figure 9:
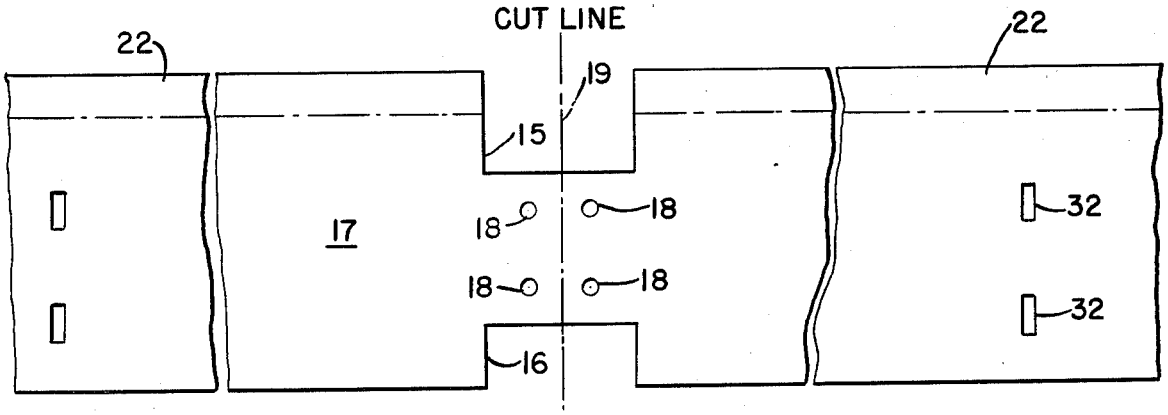
FIG. 9 is a top plan view of a blank employed in the formation of the beam of the present invention.
Figure 10:
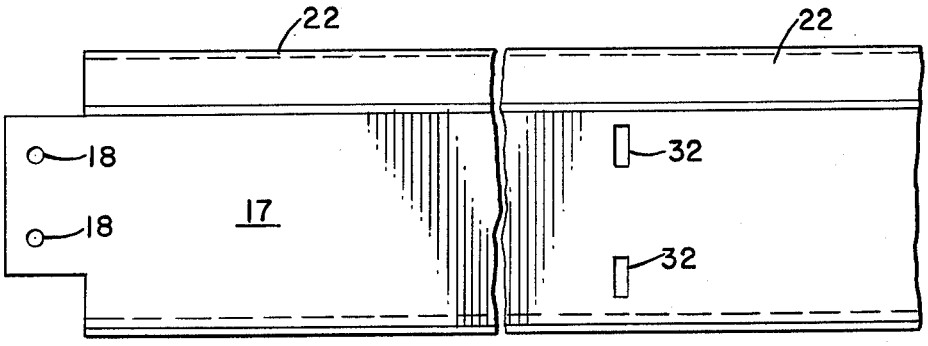
FIG. 10 is a side elevation view with parts broken away showing the beam of the present invention.

The T-shaped end frame members 11 are provided with a plurality of slots therein designated at 29. Thus, when the support beams 12 with the clips 25 secured thereto as aforesaid, are mounted on the standards, the wedge-shaped hooks 27 enter into the opening 29 and upon exerting a downward force on the beam, the wedge-shaped hooks will effect a pulling force on the beam to firmly secure the same to the T-shaped frames 11. When the wedge-shaped hooks have been firmly seated in the openings 29 the projections 28 will be caused to press firmly against the T-shaped frames. The combined action of the wedge-shaped hooks in the openings 29 and the firm engagement of the projections against the wall of the T-shaped frames will produce a tight connection between these parts which will resist any side-to-side movement of the assembled shelving unit. This is more clearly shown in FIGS. 3 and 4 of the drawings. To assist in supporting the deck 23 which, as seen in FIG. 7 of the drawings, lies flush with the top of the support beams 12, transversely extending cross beams 30 constructed of metal, plastic or the like are provided with hooks 31 at both ends thereof which are adapted to enter into slots 32 formed in the side wall of the support beams 12 as shown in FIGS. 7 and 9 of the drawings.

Cross beams 30 are of generally L-shaped cross-section with one portion thereof, 33, adapted to engage with the undersurface of the deck 23 to assist in supporting the deck on the shelving arrangement.

From the foregoing description and accompanying drawings, it will be seen that the invention provides a novel shelving arrangement for use primarily adapted for wide span shelving where the articles to be supported on the shelving are relatively light. It will also be seen that the connection between the support beams and the end frames provides for a tight connection between these parts of the shelving arrangement thereby increasing the rigidity of the structure and obviating the need for cross bracing in order to provide a staple structure.

Various features of the invention are set forth in the following claims.

I claim:

1. A shelved storage rack structure comprising end frames having end posts and bracings and cross-beams connecting the end frames, the improvement wherein each cross-beam comprises:

a vertical panel and at least one outwardly, generally horizontally extending flange adapted to support a storage rack deckplate and comprised of a reverse bend in the material of fabrication whereby to structurally rigidify and strengthen the cross-beam;

said vertical panel being at each end longitudinally extended at an intermediate section with regard to said flange;

a connector means removably fastened to the longitudinal face of each said panel extension;

the connector means comprising a vertically oriented and generally planar plate member;

first tab means extending from the free end of the plate member in the generally longitudinal direction of said panel and plate fastened thereto;

further tab means extending from the said free end of the plate member and also in the generally longitudinal direction of said panel and plate fastened thereto;

said further tab means being inwardly directed at the ends thereof and configured in the form of downwardly directed hook means;

said hook means lying intermediate the longitudinal extent of the first tab means;

said posts each being apertured on the face thereof associated with the broad plane of said vertical panel and plates and in operative association with each of said first tab and said further tab and hook means; and said hook means being configured to firmly secure the aperture defining post structure while said first tab means associate with the apertured face of the posts whereby to enhance the stability of the interconnection between the posts and cross-beams;

whereby said storage rack structure is particularly suited to be of lightweight construction and easily assembled and disassembled.

2. A shelved storage rack structure as in claim 1 wherein said horizontally extending flange is located intermediate the vertical extent of the beam.

3. A shelved storage rack structure as in any of claims 1 or 2 wherein said first tab means has a slight outward bend.

4. A shelved storage rack structure as in claim 3 wherein the outward bend of said first tab means is approximately 5°.

* * * * *